United States Patent [19]

Mack et al.

[11] 3,978,634

[45] Sept. 7, 1976

[54] SCAFFOLDING CONSTRUCTIONS

[75] Inventors: Roy Mack, Birmingham; Terence William Mayo, Redditch, both of England

[73] Assignee: Kwikform Limited, Birmingham, England

[22] Filed: July 17, 1975

[21] Appl. No.: 596,594

[30] Foreign Application Priority Data

July 19, 1974 United Kingdom ..... 32013/74

[52] U.S. Cl. ..... 52/646; 52/654; 182/128; 182/131; 182/187; 403/69; 403/73; 403/79

[51] Int. Cl.[2] ..... E04H 12/08

[58] Field of Search ..... 52/646, 650, 654; 182/131, 187, 128, 178; 403/64, 73, 79

[56] References Cited

UNITED STATES PATENTS

| | | | |
|---|---|---|---|
| 2,115,953 | 5/1938 | Hohmeister | 403/64 |
| 3,179,212 | 4/1965 | Gostling | 52/646 |

FOREIGN PATENTS OR APPLICATIONS

| | | | |
|---|---|---|---|
| 231,140 | 1/1964 | Austria | 52/650 |
| 1,160,281 | 2/1958 | France | 182/178 |
| 108,001 | 6/1958 | Pakistan | 52/646 |
| 678,293 | 9/1952 | United Kingdom | 403/64 |
| 1,143,477 | 2/1969 | United Kingdom | 52/646 |
| 1,163,000 | 9/1969 | United Kingdom | 182/178 |

*Primary Examiner*—Alfred C. Perham

*Attorney, Agent, or Firm*—Parmelee, Miller, Welsh & Kratz

[57] ABSTRACT

To enable a scaffolding structure to serve horizontally curved structures such as storage tanks, a connection is provided to allow horizontally adjacent scaffold transom element to be relatively inclined to one another in a horizonal plane. The joint includes connection means including a wedge to engage a socket afforded by a scaffold upright and such connection means is pivotally mounted on a scaffold cross member, such as a transom element, which itself affords a socket for the connection of a further cross member, such as a ledger element. Alternatively, the connection means may be pivotally mounted on a part provided with two such sockets for the releasable connection of a transom element and a ledger element.

6 Claims, 7 Drawing Figures

Figure 1:
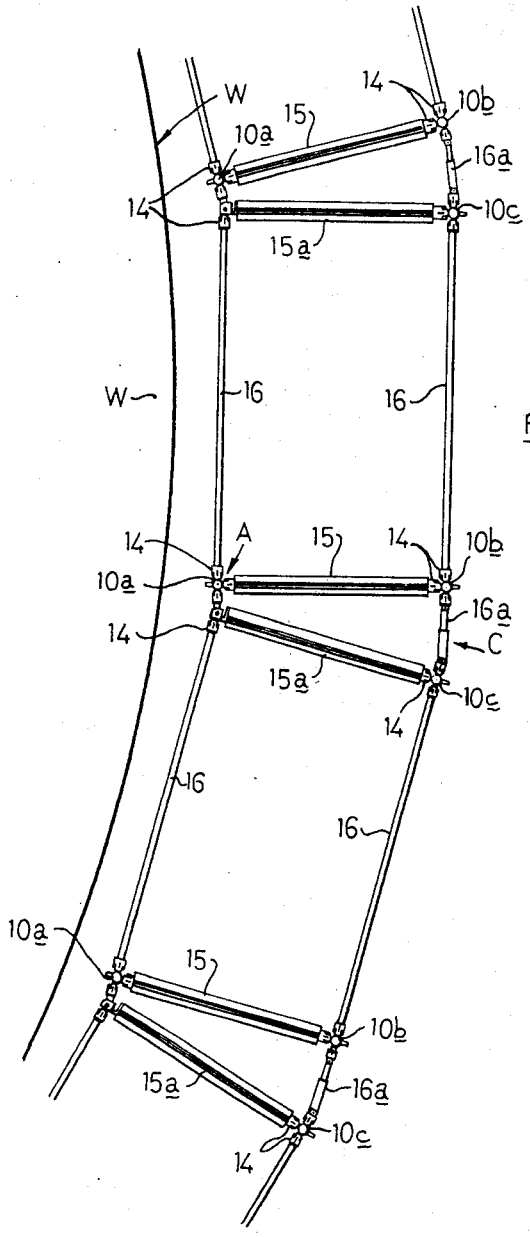

FIG. 3.
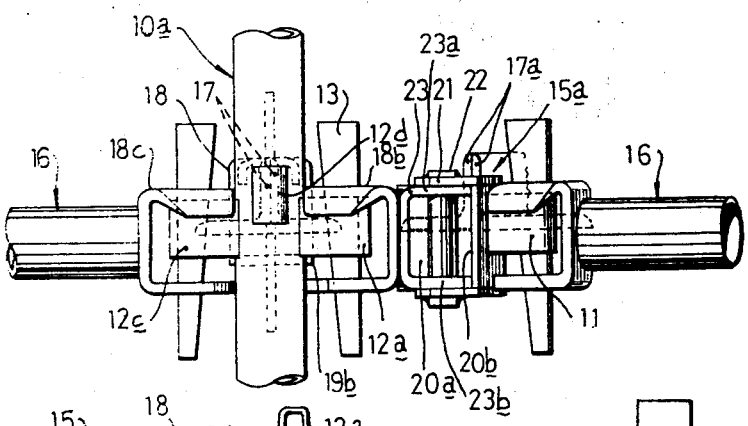
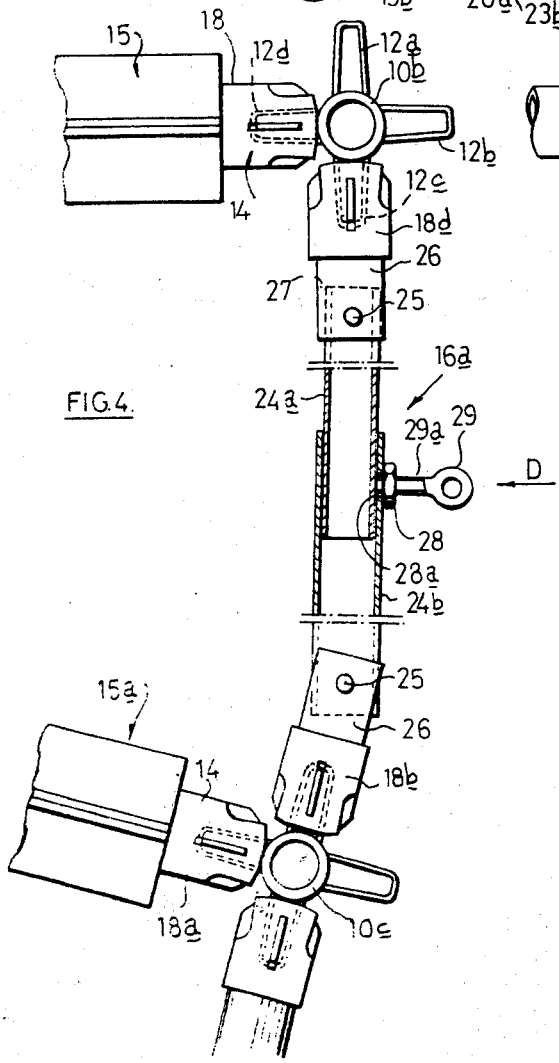
FIG. 4.
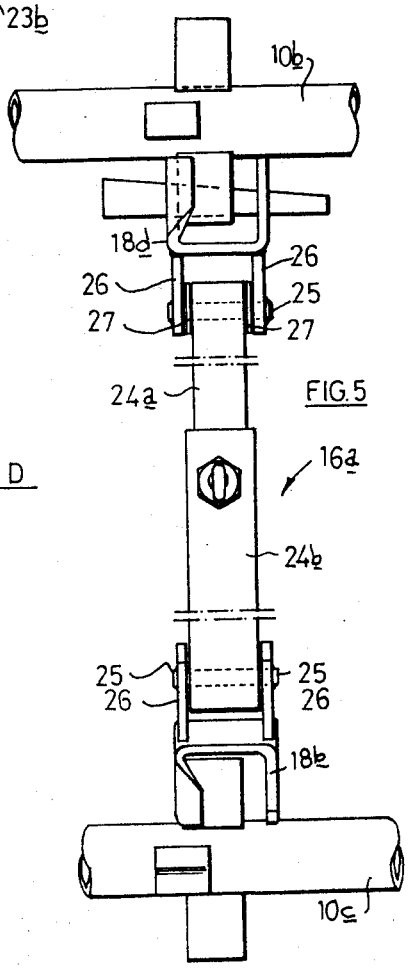
FIG. 5

SCAFFOLDING CONSTRUCTIONS

This invention concerns scaffolding constructions of the type comprising a plurality of uprights arranged in horizontally spaced parallel pairs and each provided at spaced intervals along their lengths with groups of sockets by means of which uprights are connected together by cross members each including at opposed ends thereof connection means for firmly engaging said sockets, said cross members comprising transom elements extending between the uprights of each pair and ledger elements extending between the uprights of adjacent pairs whereby staging can be supported between adjacent pairs of uprights. Such scaffolding constructions are hereinafter referred to as being of the kind specified.

Examples of scaffolding constructions of the kind specified utilising various different forms of connection means whereby the cross members are wedgingly engaged with the sockets are described in our prior British Pat. specifications Nos. 985,912/3, 1,163,532/3, 1,180,562 and 1,278,596. In other known systems bolts are employed instead of wedging arrangements.

Prior constructions of this type provide only for the assembly of the transom elements and ledger elements in mutually perpendicular relation. Whilst this enables a scaffolding construction of the kind specified to be assembled alongside a straight wall, or around a right angled corner, it does not conveniently allow the scaffolding to extend around corners of an angle other than a right angle, or alongside surfaces which are curved in a horizontal plane.

The object of the present invention is to enable a scaffolding construction of the kind specified to be adapted to follow a curved surface or to extend readily around a corner of other than a right angle.

According to the present invention we provide in or for a scaffolding construction of the kind specified a cross member at one end of which said connection means for firmly engaging a socket afforded by the upright is mounted for pivotal movement about a vertical axis, and at said one end there is provided an additional socket similar to the sockets afforded by the uprights, whereby such pivoted cross member can be disposed to extend at an angle other than a right angle relative to other cross members connected to other sockets of the same group as that to which the pivoted cross member is connected, with a further cross member connected at one end to the additional socket provided on said pivoted cross member.

The additional socket may be presented perpendicularly transverse to the length of the cross member on which it is provided and the pivotally mounted connection means may be movable through a range of positions between limits in which it is substantially opposed respectively to said additional socket and to the end of said cross member.

If desired means may be provided for retaining the pivotally mounted connection means in any of a plurality of positions of adjustment, but preferably said means are free to adopt any desired position between said limits.

Most conveniently, said cross member is in the form of a transom element adapted to receive the ends of a number of scaffold boards and for this purpose it may be of known inverted T-shape in transverse section.

Alternatively, the cross member may be in the form of a ledger element.

Whilst the pivotally mounted connection means is preferably carried on a bracket which is fixedly secured to a cross member in the form of a transom element or a ledger element, the pivotally mounted connection means may alternatively be carried by an element which includes two of said additional sockets whereby it can be releasably connected to two cross members, comprising respectively a transom element and a ledger element, provided with said connection means for wedgingly engaging such sockets.

The other end of the cross member in accordance with the invention may be provided with connection means of known form adapted for direct, non-pivotal, connection to a socket carried by an upright provided adjacent to, and in addition to, uprights between which a fixed cross member extends. Alternatively, pivotally mounted connection means may be provided at both ends.

Thus, where it is required that a scaffolding construction of the kind specified extends alongside a curved surface, or around a corner of other than a right angle, instead of using two horizontally adjacent fixed transom elements each supported by a respective pair of uprights so that the two transom elements extend at the desired angle relative to each other, one fixed transom element may be supported by an associated pair of uprights and the other, pivoted, transom element can be supported at its pivoted end by one of the uprights of said pair, the other end of the pivoted transom element being supported by a single additional upright.

Alternatively, one fixed transom may be supported by an associated pair of uprights and the other can be supported between a third upright and the socket provided at the end of a pivoted ledger element itself connected to one of said pair of uprights through said pivotally mounted connection means.

In either way, where four upright elements would previously have been required to support an adjacent pair of transom elements arranged relative to one another at an angle other than a right angle, the invention makes it possible to utilise only three such upright elements.

Figure 2:
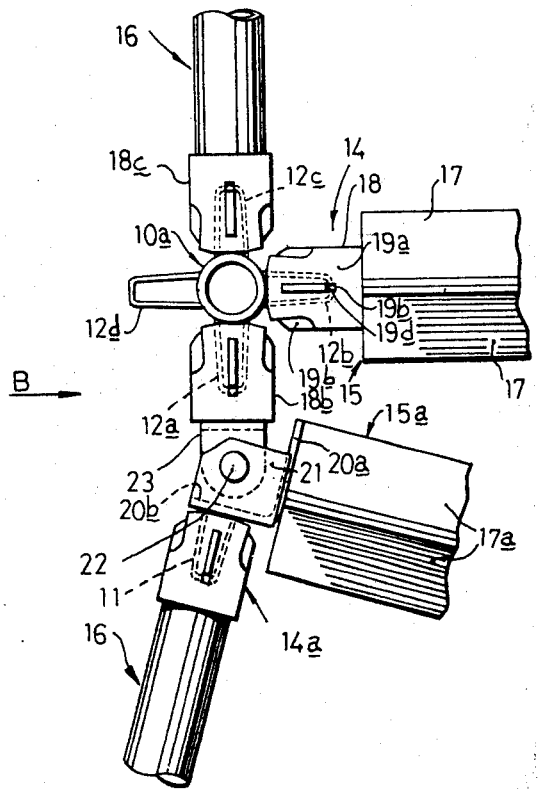
Figure 6:
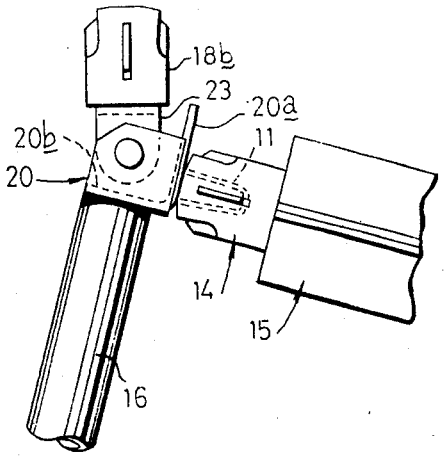
Figure 7:
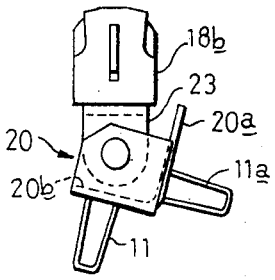

The invention will now be described by way of example with reference to the accompanying drawings wherein:

FIG. 1 is a fragmentary plan view of a typical installation in accordance with the invention, FIG. 2 is an enlarged plan view of the region indicated at A in FIG. 1 showing one end portion of a pivoted transom element secured to a scaffold upright at an acute angle to a non-pivotal transom element also secured to the same upright, FIG. 3 is a side view in the direction of arrow B of FIG. 2, FIG. 4 is an enlarged plan view in the region indicated at C in FIG. 1 showing the opposite ends of the transom elements shown in FIG. 2 and an adjustable length ledger element connected between the upright elements to which said other ends of the transom elements are secured, FIG. 5 is a side view in the direction of arrow D of FIG. 4, and FIGS. 6 and 7 are plan views similar to FIG. 2 showing alternative embodiments.

In the accompanying drawings there is shown a scaffolding construction comprising a plurality of pairs of uprights 10*a* and 10*b* each of the type having, at spaced intervals along its length, groups of four sockets 12*a* to 12*d* each formed from a strip of metal formed to channel shape with the free ends of the limbs of the channel secured to the external surface of the scaffolding upright so as to define a vertically disposed, open-ended socket in combination therewith.

The sockets 12*a* to 12*d* are each of generally elongated form in plan view with the limbs thereof substantially parallel so as to define between them vertical slots for the reception of wedge members 13 forming part of known connecting means 14 provided at the ends of cross members whereby the uprights are interconnected. Two types of cross members are provided, transom elements 15 and ledger elements 16. The transom elements 15 extend between a pair of uprights 10*a* and 10*b* to receive the ends of scaffold boards (not shown) which extend to a further transom element connected between further pairs of uprights. Because the sockets of each group are arranged in mutually transverse pairs 12*a*, 12*c* and 12*b*, 12*d* it is normally only possible to arrange the uprights in a rectangular array.

The transom elements 15 are of known form and each comprises a pair of angle section members 17 arranged back-to-back and having secured thereto at opposed ends respective C-shape brackets 18 forming part of the connection means previously mentioned and adapted to embrace any of the sockets carried by the uprights 10*a* and 10*b*. The brackets 18 each carry a respective one of the wedge members 13 (which are omitted for clarity except in FIG. 3) and each wedge members passes through aligned slots 19*b* and 19*d* in the upper and lower limbs. 19*a* and 19*c* of the bracket 18 and through the interior of the socket with which the bracket is assembled so as to secure the transom element 15 in wedging engagement with the selected socket.

The ledger elements 16 are also of known form and each comprises a length of tube having secured thereto at opposed ends respective C-shape brackets 18*c* identical with the brackets 18 and comprising part of connecting means 14 as previously described.

In order to enable the construction to conform to a curved wall W as shown in FIG. 1 each pair of uprights 10*a* and 10*b* has associated therewith an additional upright 10*c* and an additional transom element 15*a* is provided to extend between each inner upright 10*a* and the associated additional upright 10*c*, and each of the innermost ledger elements 16 is connected between adjacent inner uprights 10*a* through the intermediary of one of the additional transom elements 15*a* at one end, whilst each of the outermost ledger elements 16 is connected between the outer upright 10*b* to which one of the normal transom elements 15 is connected and the additional upright 10*c* which is associated with the adjacent normal transom element 15. Further, additional, ledger elements 16*a*, preferably of adjustable length, are connected between each outer upright 10*b* and its associated additional upright 10*c*.

The manner in which each inner upright 10*a* serves to support two transom elements 15 and 15*a* in the same horizontal plane and extending at an acute angle to one another is shown in detail in FIGS. 2 and 3.

The sockets 12*a* and 12*c* extending transverse to the socket 12*b* to which the normal transom element 15 is connected would normally be used to secure ledger elements 16 extending in a horizontal plane perpendicular to the transom element 15. However, in the illustrated arrangement, although one such ledger element 16 is connected to the socket 12*c*, the opposed socket 12*a* is utilised for the connection of the additional transom element 15*a*.

The additional transom element 15*a*, like the normal transom element 15, is formed from a pair of angle section members 17*a*, secured back-to-back so that the element is of inverted T-section, and at one end (see FIG. 4) the members 17*a* carry rigidly secured thereto a C-shape bracket 18*a* identical with the bracket 18 and comprising part of additional connecting means 14 to enable that end of the element 15*a* to be secured to an associated additional upright 10*c* in like manner.

However, at the other end, as shown particularly in FIGS. 4 and 5, the additional transom element 15*a* has a further similar C-shape bracket 18*b* pivotally secured thereto for angular movement about a vertical axis. This end of the element 15*a* also has rigidly connected thereto a socket member 11 to enable a ledger element 16 to be connected to the transom element 15*a* by further connecting means 14*a* in such a manner as to extend horizontally therefrom and perpendicularly thereto.

For this purpose, the angle section members 17*a* have secured at this end one limb 20*a* of an angle section bracket 20, of which the upper limb 20*b* carries the socket member 11. Two plates 21 are secured to the bracket 20 and carry between them a vertically disposed fixed pin 22. The pin 22 passes through aligned apertures in the upper and lower limbs 23*a* and 23*b* of an attachment bracket 23 to which the vertical web of the bracket 18*b* is secured.

It will thus be apparent that the transom element 15*a* is free to swivel about the vertical axis defined by the pin 22 so as to be set at a range of angles relative to the transom element 15, the additional socket member 11 enabling a ledger element 16 to be associated with the transom element 15 and to extend at right angles thereto parallel to a similar ledger element 16 connected to the additional upright 10*c* to which the other end of the transom element 15*a* is connected. The transom elements 15 and 15*a* may therefore be used to support respective sets of staging extending at an angle to one another, with an additional, appropriately shaped, staging panel supported between the elements 15 and 15*a*.

As can be seen, the bracket 18*b* is freely movable through a range of about 90° between limits in which it is substantially opposed to the socket member 11 and to the end of the transom element 15*a* respectively.

Whilst it is preferred for the pivoted bracket 18*b* to be freely swivellable about the axis defined by the pin 22, provision may be made for locking the bracket 18 in any of a plurality of positions of angular adjustment. For this purpose, a pair of aligned holes may be formed in the plates 21 to receive a removable pin adapted to extend through any of several pairs of aligned holes which may be formed in respective rows in the limbs 23*a* and 23*b* of the attachment bracket 23.

This arrangement enables the scaffolding construction readily to extend around corners of other than a right angle, or alongside surfaces which are curved in the horizontal plane.

As previously mentioned, the adjacent uprights 10*b* and 10*c*, to which the outer ends of the transom elements 15 and 15*a* are connected, are themselves interconnected by means of an adjustable ledger element 16*a* which comprises a pair of telescopically overlapping tubes 24*a* and 24*b* each carrying at its free end a respective C-shape bracket 18*d*, identical with the bracket 18 previously mentioned and again forming part of connection means 14. The brackets 18*d* are pivotally mounted on the tubes 24*a* and 24*b* by means of respective pins 25 secured between lugs 26 themselves secured to the brackets 18*d* as shown in FIG. 5. In view of the lesser diameter of the inner tube 24*a*, a collar 27 of the same cross-sectional dimensions as the outer tube 24*b* is provided at the ends of the inner tube 24*a* where the bracket 18*d* is attached, and the pin 25 extends additionally through aligned holes in this collar.

The inner and outer tubes 24*a* and 24*b* may be secured together in any desired degree of overlap by any suitable means. In the arrangements shown in FIGS. 4 and 5, a nut 28 is welded to the outer tube 24*b* over an aperture 28*a* and a threaded bolt 29 is arranged with its shank 29*a* extending into and through the aperture 28*a* frictionally to engage the outer surface of the inner tube 24*a*. If positive engagement is required, the inner tube could be formed with a row of apertures to receive the end of the shank 29*a*.

Whilst in the accompanying drawings the pivoted brackets 18*b* are shown as carried by the additional transom element 15*a*, it would alternatively be possible for such a specifically adapted ledger element 16 as shown in FIG. 6. In this case, the additional transom element 15*a* is replaced by a further normal transom element, identical with the transom element 15. The tube comprising the ledger element 16 is secured directly to the bracket 20 on the limb 20*b*, and the socket member 11 secured to the other limb 20*a*.

In a still further alternative version as shown in FIG. 7, the pivoted bracket 18*b* forms part of a coupling which is structurally separate from both transom and ledger elements. The angle bracket 20 to which the bracket 18*b* is pivotally connected by means of the pin 22 has a further socket member 11*a* similar to the member 11 secured to the limb 20*a* instead of the member 17*a* of the additional transom element 15*a*. In this case, both the transom element and the ledger element are connected to the angle bracket 20 by connecting means of the type indicated generally at 14. In the simplified version of such a separate coupling the attachment bracket 23 carried by the bracket 18*b* could embrace a short length of scaffold tube having two socket members 11 secured thereto in mutually perpendicular relation.

Whilst the invention has been described throughout specifically in relation to scaffolding constructions in which the connection means comprises a wedge member 13 extending through aligned slots in the upper and lower limbs of a C-shape bracket, and thus into and through a socket defined by substantially parallel limbs of U-shaped part, it will be understood that the invention is not specifically limited to the use of this particular type of connection means, and any other known type of connection means for wedgingly engaging sockets may be utilised. In particular, the connection means may be of the type in which the cross members are additionally provided with a fixed spigot element adapted to enter into the socket, and the wedge member co-operates either internally or externally with the socket member in known manner, or indeed other known types of connecting mechanisms may be employed.

We claim:

1. In a scaffolding structure comprising a. a plurality of generally vertical uprights arranged in horizontally spaced parallel pairs and each provided at spaced intervals along their lengths with groups of sockets, and b. cross members each including at opposed ends thereof connecting means firmly engaging selected ones of said sockets, the cross members comprising firstly transom elements extending between the uprights of said pair and secondly ledger elements extending between the uprights of adjacent pairs, whereby staging can be supported between adjacent pairs of said uprights, the improvement comprising c. at least one additional cross member having at one end connection means for firmly engaging a socket afforded by one of said uprights mounted for pivotal movement about a vertical axis, such additional, pivoted cross member extending at an angle other than a right angle relative to one of said transom elements which extends between the uprights of one of said pairs of uprights whilst connected to another socket of the same group as that to which the pivoted cross member is connected, and d. an additional socket, similar to the sockets afforded by the uprights, is provided at said one end of the pivoted cross member with one of said ledger elements connected at one of its ends to said additional socket on said pivoted cross member.

2. A scaffolding construction as claimed in claim 1 wherein said additional cross member at its other end is connected to an additional upright by connection means firmly engaging a socket afforded by said additional upright, and an adjustable length cross member connects the latter upright to an adjacent upright belonging to the pair between which extends the transom element which is connected to one of the sockets of the same group as that to which the pivoted cross member is connected by said pivotally mounted connecting means.

3. A scaffolding construction as claimed in claim 2 wherein said adjustable length cross member comprises a pair of telescopically overlapping tubes each carrying at its free end connection means for firmly engaging a socket afforded by the uprights.

4. A scaffolding construction as claimed in claim 3 wherein said connection means carried by said tubes are pivotally secured to the respective tubes for angular movement about vertical axes.

5. A scaffolding construction as claimed in claim 1 wherein said additional cross member comprises a transom element of inverted T-shape in transverse section.

6. A scaffolding construction as claimed in claim 1 wherein said additional cross member comprises a ledger element.

* * * * *